US009869128B1

(12) United States Patent
Allen et al.

(10) Patent No.: US 9,869,128 B1
(45) Date of Patent: Jan. 16, 2018

(54) INSTALLATION SYSTEMS AND METHODOLOGY FOR HELICAL STRAKE FINS

(71) Applicant: VIV Solutions LLC, Richmond, TX (US)

(72) Inventors: Donald Wayne Allen, Richmond, TX (US); Julie Ann Dehne, Cypress, TX (US); William Andrew West, Friendswood, TX (US)

(73) Assignee: VIV Solutions LLC, Richmond, TX (US)

( * ) Notice: Subject to any disclaimer, the term of this patent is extended or adjusted under 35 U.S.C. 154(b) by 300 days.

(21) Appl. No.: 13/841,720

(22) Filed: Mar. 15, 2013

Related U.S. Application Data

(60) Provisional application No. 61/729,564, filed on Nov. 24, 2012.

(51) Int. Cl.
*F15D 1/10* (2006.01)
*E21B 7/12* (2006.01)
*E21B 41/00* (2006.01)

(52) U.S. Cl.
CPC ..... *E21B 7/12* (2013.01); *E21B 41/0007* (2013.01)

(58) Field of Classification Search
CPC ..... E21B 7/12; E21B 41/0007; E21B 17/01; F15D 1/12; Y10T 29/49718;
(Continued)

(56) References Cited

U.S. PATENT DOCUMENTS 2,401,783 A 6/1946 Wilcoxon
3,163,221 A 12/1964 Shatto, Jr.
(Continued)

FOREIGN PATENT DOCUMENTS

GB 2335248 9/1999
GB 2362444 11/2001
(Continued)

OTHER PUBLICATIONS

VIV Solutions, Non-final Office Action dated Aug. 21, 2012 for U.S. Appl. No. 13/274,207., 7 pages.
(Continued)

*Primary Examiner* — Jun Yoo
(74) *Attorney, Agent, or Firm* — Blakely Sokoloff Taylor & Zafman LLP

(57) ABSTRACT

An apparatus and method for helically installing a vortex-induced vibration (VIV) suppression fin about a tubular. The apparatus may include an outer ring member dimensioned to encircle an underlying tubular and an inner ring member positioned concentrically inward from the outer ring member. The inner ring member is configured to rotate with respect to at least one of the outer ring member or the tubular as the outer ring member moves along the tubular. The apparatus may further include a fin guide configured to receive a fin and helically position the fin along the tubular as the inner ring member rotates. A method of installing a vortex-induced vibration (VIV) suppression fin about a tubular may include removably attaching a VIV suppression fin to an installation member. The installation member may be positioned along a tubular and moved about the tubular to helically position the fin around the tubular.

8 Claims, 20 Drawing Sheets

(58) Field of Classification Search
CPC ..... Y10T 29/49881; Y10T 29/49895; Y10T 29/49947; Y10T 29/53657
See application file for complete search history.

(56) References Cited

U.S. PATENT DOCUMENTS

| | | | | |
|---|---|---|---|---|
| 3,176,646 | A | 4/1965 | Natwick et al. | |
| 3,194,204 | A | 7/1965 | Nichols et al. | |
| 3,321,924 | A * | 5/1967 | Liddell | E02D 5/60 138/110 |
| 3,343,515 | A | 9/1967 | Nichols et al. | |
| 3,454,051 | A * | 7/1969 | Goepfert | F16L 1/24 114/243 |
| 3,472,196 | A | 10/1969 | Ewing et al. | |
| 3,557,840 | A * | 1/1971 | Maybee | F16L 59/026 138/149 |
| 3,611,976 | A | 10/1971 | Hale | |
| 3,962,982 | A | 6/1976 | Marchay et al. | |
| 4,116,015 | A | 9/1978 | Duncan | |
| 4,365,574 | A | 12/1982 | Norminton | |
| 4,567,841 | A | 2/1986 | Hale | |
| 4,705,331 | A | 11/1987 | Britton | |
| 4,832,530 | A | 5/1989 | Andersen et al. | |
| 5,456,199 | A | 10/1995 | Kernkamp | |
| 5,722,340 | A | 3/1998 | Sweetman | |
| 5,869,159 | A * | 2/1999 | Padilla | 428/40.1 |
| 6,067,922 | A | 5/2000 | Denison et al. | |
| 6,347,911 | B1 | 2/2002 | Blair et al. | |
| 6,561,734 | B1 * | 5/2003 | Allen et al. | 405/216 |
| 6,695,539 | B2 | 2/2004 | McMillan et al. | |
| 6,755,595 | B2 | 6/2004 | Oram | |
| 6,789,578 | B2 | 9/2004 | Latham et al. | |
| 6,896,447 | B1 | 5/2005 | Taquino | |
| 6,928,709 | B2 | 8/2005 | McMillan et al. | |
| 6,971,413 | B2 | 12/2005 | Taylor et al. | |
| 6,994,492 | B2 | 2/2006 | McMillan et al. | |
| 7,458,752 | B2 | 12/2008 | Esselbrugge et al. | |
| 7,485,801 | B1 * | 2/2009 | Pulter | F16L 59/026 174/15.2 |
| 7,578,038 | B2 | 8/2009 | McMillan et al. | |
| 7,842,396 | B2 * | 11/2010 | White | F28F 9/20 428/131 |
| 8,297,883 | B2 | 10/2012 | Masters et al. | |
| 8,511,245 | B2 | 8/2013 | Dehne et al. | |
| 8,622,657 | B2 | 1/2014 | Masters et al. | |
| 9,523,456 | B1 | 12/2016 | Allen et al. | |
| 2003/0074777 | A1 * | 4/2003 | McMillan et al. | 29/428 |
| 2005/0082730 | A1 | 4/2005 | Murray et al. | |
| 2005/0141967 | A1 | 6/2005 | Giles et al. | |
| 2006/0280559 | A1 | 12/2006 | Allen et al. | |
| 2007/0140797 | A1 | 6/2007 | Armstrong | |
| 2007/0296229 | A1 | 12/2007 | Chauvin et al. | |
| 2008/0236469 | A1 | 10/2008 | Masters et al. | |
| 2009/0076529 | A1 | 3/2009 | Ganti | |
| 2009/0185867 | A1 | 7/2009 | Masters et al. | |
| 2009/0252559 | A1 | 10/2009 | Masters et al. | |
| 2010/0129159 | A1 | 5/2010 | Brown | |
| 2013/0014685 | A1 | 1/2013 | Tonchia | |
| 2013/0039702 | A1 | 2/2013 | West et al. | |
| 2013/0064607 | A1 | 3/2013 | Masters et al. | |
| 2015/0086276 | A1 | 3/2015 | Harbison et al. | |

FOREIGN PATENT DOCUMENTS

| | | |
|---|---|---|
| WO | WO-2005026560 | 3/2005 |
| WO | WO-2008064102 | 5/2008 |
| WO | WO-2009070483 | 6/2009 |
| WO | WO-2011022332 | 2/2011 |

OTHER PUBLICATIONS

VIV Solutions LLC, European search report dated Sep. 26, 2012 for EP Appln. No. 12168141.5.
VIV Solutions LLC, Final Office Action dated Dec. 8, 2015, U.S. Appl. No. 13/706,209.
VIV Solutions LLC, Non-Final Office Action dated May 12, 2017, U.S. Appl. No. 15/099,471.
VIV Solutions LLC, Non-Final Office Action dated May 5, 2015, U.S. Appl. No. 13/706,209.

* cited by examiner

INSTALLATION SYSTEMS AND METHODOLOGY FOR HELICAL STRAKE FINS

CROSS-REFERENCE TO RELATED APPLICATION

The application claims the benefit of the earlier filing date of U.S. Provisional Patent Application No. 61/729,564, filed Nov. 24, 2012 and incorporated herein by reference.

BACKGROUND OF THE INVENTION

A difficult obstacle associated with the exploration and production of oil and gas is management of significant ocean currents. These currents can produce vortex-induced vibration (VIV) and/or large deflections of tubulars associated with drilling and production. VIV can cause substantial fatigue damage to the tubular or cause suspension of drilling due to increased deflections. Both helical strakes and fairings can provide sufficient VIV suppression, but can be slow and unsafe to install.

Most helical strakes consist of one or more fins that are attached to a shell, often with the fins molded into the shell. However, the elimination of the shell can reduce cost substantially.

One method for eliminating the shell of a helical strake section is to wind the fins around the pipe directly without a shell present. However, it is difficult to align the pitch of each of the fins quickly and/or precisely without using measuring tools which can substantially slow down the installation.

SUMMARY OF THE INVENTION

The present invention is directed to an installation assembly, such as a machine, and methods of, installing helical strake fins around a pipe directly without a shell present. The machine is configured to allow for quick and precise installation of the fins. In one embodiment, installation assembly may include an outer ring member dimensioned to encircle an underlying tubular and an inner ring member positioned concentrically inward from the outer ring member. The inner ring member is configured to rotate with respect to at least one of the outer ring member or the tubular as the outer ring member moves axially along the tubular. The apparatus may further include a fin guide configured to receive a fin and helically position the fin along the tubular as the inner ring member rotates.

Another embodiment of the invention the installation assembly may include a support member configured to wrap a VIV suppression fin helically around a tubular. The support member may be dimensioned to retain the VIV suppression fin along an inner surface. The support member may also be modifiable between a first open configuration and a second closed configuration. In the closed configuration, the VIV suppression fin is in a helical shape such that when the support member is wrapped around a tubular, the fin is helically positioned around the tubular. The support member may further include an attachment opening formed through a portion of the support member aligned with the VIV suppression fin. The opening may be used to receive a fastener to facilitate attachment of the VIV suppression fin helically around the tubular once the support member is removed.

Another embodiment of the invention may include a method of installing a vortex-induced vibration (VIV) suppression fin about a tubular which includes removably attaching a VIV suppression fin to an installation member. The installation member may be positioned along a tubular and moved about the tubular to helically position the fin around the tubular. Once the fin is helically positioned about the tubular, the installation member may be removed.

The above summary does not include an exhaustive list of all aspects of the present invention. It is contemplated that the invention includes all apparatuses that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments disclosed herein are illustrated by way of example and not by way of limitation in the figures of the accompanying drawings which like references indicate similar elements. It should be noted that references to "an" or "one" embodiment in this disclosure are not necessarily to the same embodiment, and they mean at least one.

DETAILED DESCRIPTION OF THE INVENTION

In this section we shall explain several preferred embodiments with reference to the appended drawings. Whenever the shapes, relative positions and other aspects of the parts described in the embodiments are not clearly defined, the scope of the embodiment is not limited only to the parts shown, which are meant merely for the purpose of illustration. Also, while numerous details are set forth, it is understood that some embodiments may be practiced without these details. In other instances, well-known structures and techniques have not been shown in detail so as not to obscure the understanding of this description.

Figure 1A:
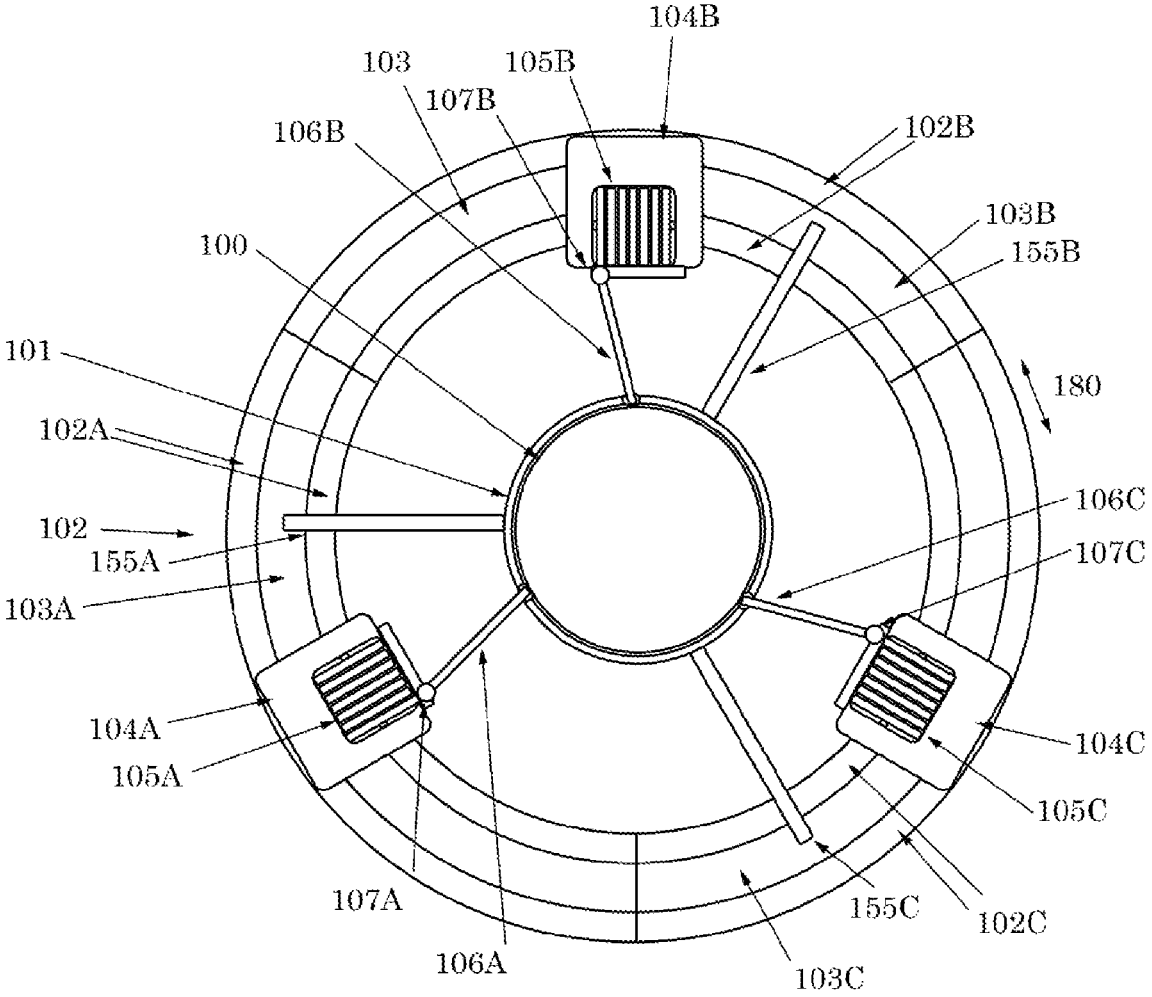
FIG. 1A is a top view of one embodiment of a reeled installation system turning ring.

Referring now to the invention in more detail, FIG. 1A illustrates a top view of a reeled installation system turning ring. The turning ring 103 is made up of three sections 103A, 103B, and 103C that are contained in ring housing 102 which is also made up of three sections 102A, 102B, and 102C. Each of ring sections 103A-103C and housing sections 102A-102C may be separable to facilitate positioning of the assembly around tubular 100, or integrally formed as one continuous unit. Connectors 155A, 155B, and 155C join ring 103 with ring 101, which surrounds tubular 100. Ring 101 helps to stabilize ring 103 around tubular 100 at a fixed distance. Reels 104A, 104B, and 104C contain fin rolls 105A, 105B, and 105C, respectively. Reels 104A-104C may be fixedly attached to turning ring 103 by any suitable mechanism (e.g., bolt, screw, bracket, molding, adhesive or the like) such that reels 104A-104C rotate along with turning ring 103. Guides 107A, 107B, and 107C assist in laying out fins 106A, 106B, and 106C, respectively.

Again referring to FIG. 1A, when ring 103 is rotated (as illustrated by arrow 180), reels 104A-104C and ring housing 102 are also rotated. As reels 104A-104C rotate, fins 106A-106C, which are wound around reels 104A-104C, are unwound and laid out onto the underlying tubular 100. By rotating ring 103 and laying out fins 106A-106C as tubular 100 is lowered (into the page), fins 106A-106C produce a helical pattern on tubular 100. This helical pattern can be controlled by varying the rate of rotation of ring 103 relative to the lowering of tubular 100. Ring 103 may be rotated manually, such as by a technician on deck, or automatically, such as by a motor assembly connected to ring 103. Once fins 106A-106C are helically arranged along tubular 100, the reeled installation system can be removed leaving fins 106A-106C helically installed along tubular 100.

Any number of ring sections 103A-103C, housing sections 102A-102C, connectors 155A-155C, reels 104A-104C, fin rolls 105A-105C, fins 106A-106C, and guides 107A-107C may be used depending upon the design. Fins 106A-106C may be made of material fabricated solely to act as a VIV suppression device or may be made of other auxiliary lines that assist with, or perform, other functions, or any combination thereof.

Still referring to FIG. 1A, tubular 100 may range between 2 inches and 60 inches in diameter. Fins 106A-106C will typically have a thickness within a range from 5 percent to 30 percent of the diameter of tubular 100. Reels 104A-C may be dimensioned to contain between 6 ft. and 1000 ft. of fins 106A-106C on fin rolls 105A-105C.

Still referring to FIG. 1A, ring 103, housing 102, connectors 155A-155C, and reels 104A-104C may be made of any suitable material including, but not limited to, metal, plastic, fiberglass, wood, and composites. However, the material must be strong enough so that ring 103 may turn freely. Fin rolls 105A-105C and fins 106A-106C may also be made of any suitable material but typically will be made of a more flexible material such as an elastomer, plastic, or composite.

Figure 1B:
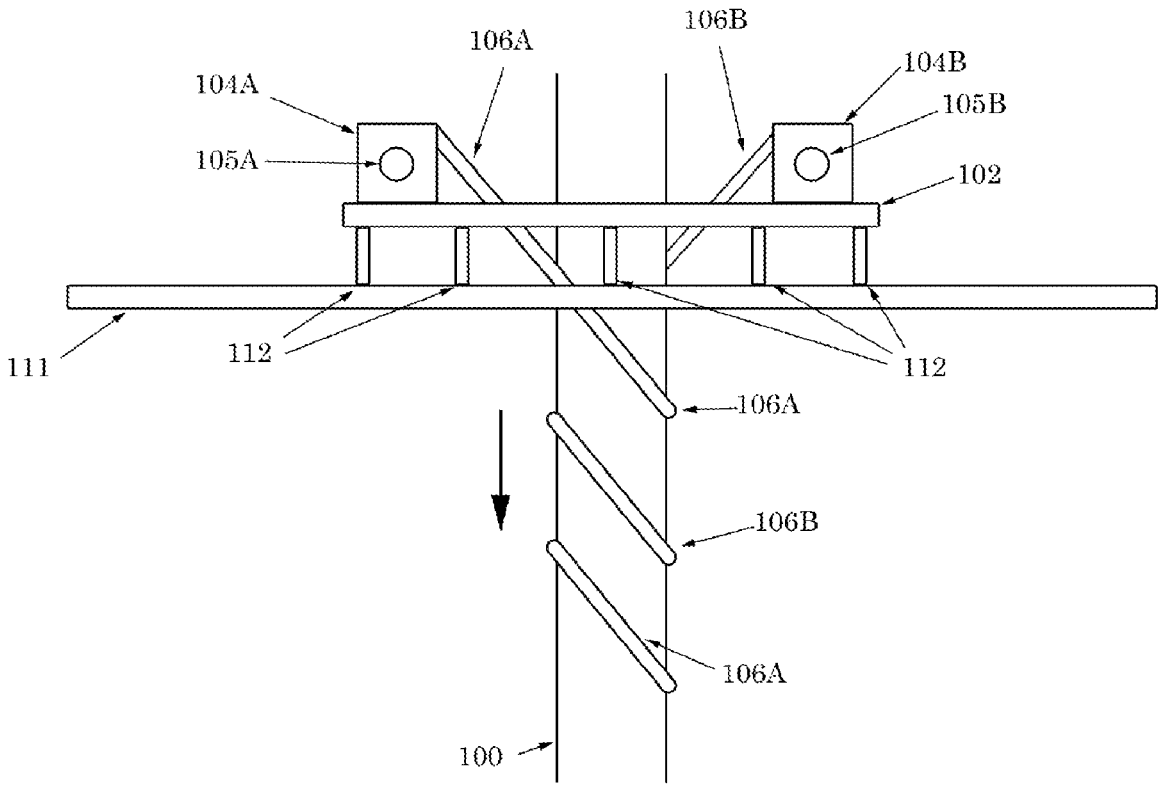
FIG. 1B is side view of the reeled installation system of FIG. 1A with a turning ring.

Referring now to FIG. 1B, FIG. 1B is a side view of FIG. 1A but with only two fins 106A-106B shown wrapped around tubular 100, and thus only two reels 104A-104B and two fin rolls 105A-105B are needed. Housing 102 sits on legs 112 which sit on deck 111.

Again referring to FIG. 1B, since housing 102 is essentially fixed to deck 111 through legs 112, the rotation of reels 104A-104B is dependent upon rotation of the ring (not visible but shown in FIG. 1A as ring 103) which is constrained by housing 102. By lowering tubular 100 while the ring (and therefore housings 104A-104B) is rotating, the fins 106A-106B are wrapped in a helical fashion around tubular 100.

Still referring to FIG. 1B, deck 111 is typically part of an offshore drilling or production platform, but can also represent other support structures. For example, fins 106A-106B could be wrapped around a structure in air as tubular 100 is raised (instead of lowered) while the ring is rotating. In addition, banding of the fins 106A-106B can occur at the same, or different, level or deck 111.

Figure 1C:
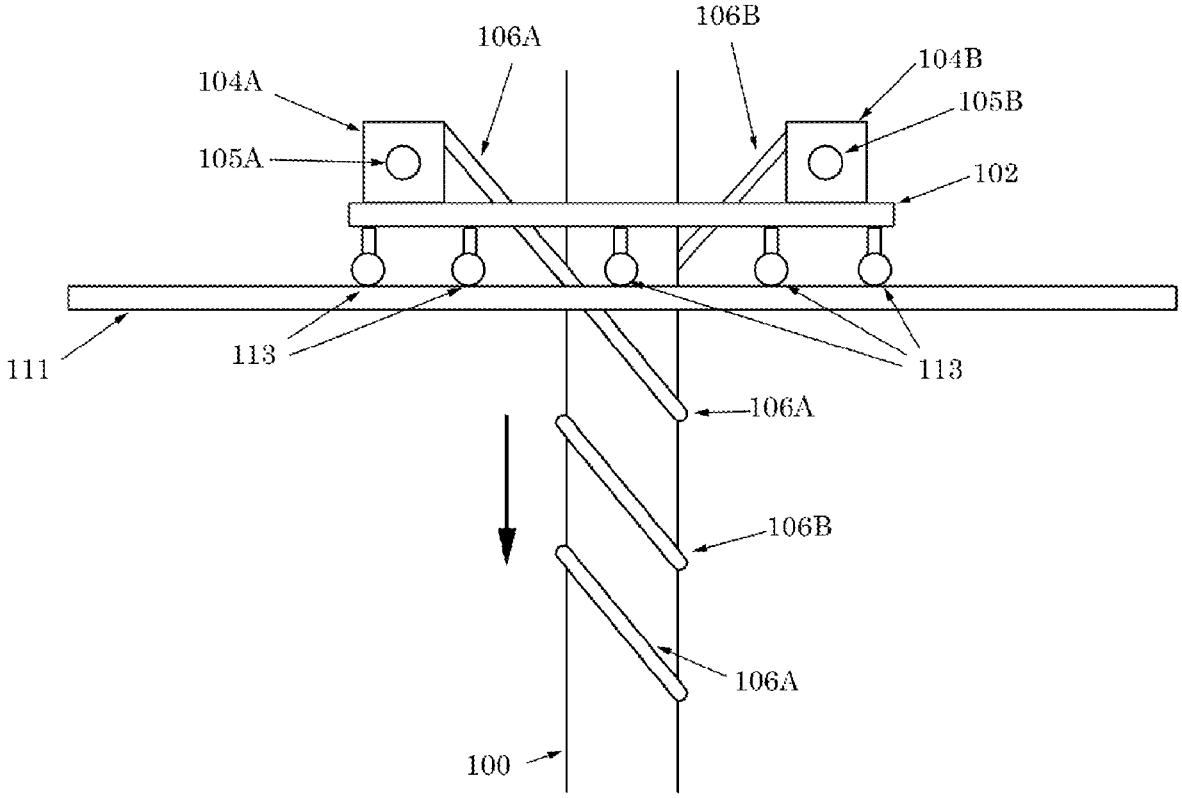
FIG. 1C is side view of the reeled installation system of FIG. 1B with wheels to turn the rail system.

Referring now to FIG. 1C, this figure is similar to FIG. 1B except that legs 112 have been replaced with casters 113.

Again referring to FIG. 1C, since casters 113 are able to roll along deck 111, housing 102 may be rotated around tubular 100 and thus a rotatable ring, such as ring 103 of FIG. 1A, is not required. This simplifies the system but requires a deck 111 that can accommodate the rolling action of the casters 113 and also requires careful rotation of housing 102 about tubular 100 to keep them concentric.

Figure 1D:
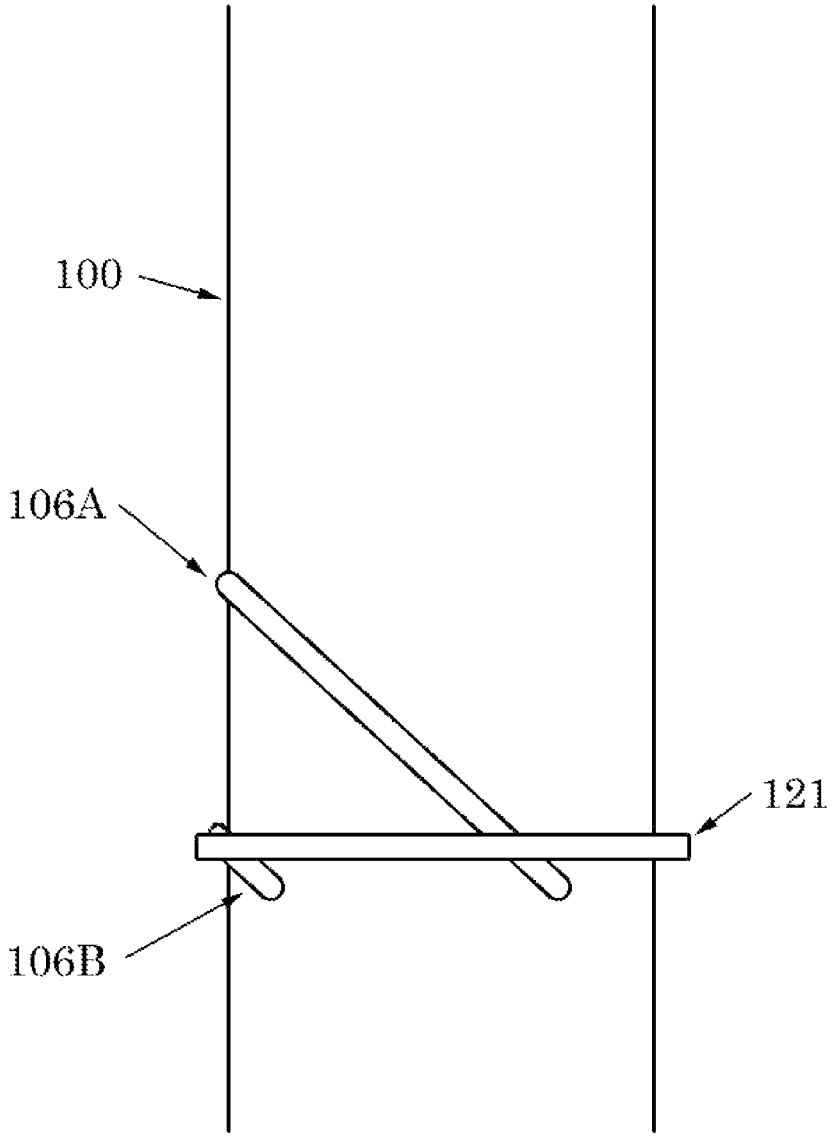
FIG. 1D is a side view of one embodiment of a band holding solid material fins in place.

Referring to FIG. 1D, FIG. 1D shows how a typical end termination can be made for fins 106A-106B in order to secure them to tubular 100. Representatively, in one embodiment, band 121 is put under tension so that it produces compression forces on fins 106A-B and tubular 100. Band 121 may be made of any suitable material including, but not limited to metal, plastic, synthetic, composite, rubber or other elastomer, or combinations of these materials. Alternatively, a collar or other clamp may be used in place of band 121. Typically, band 121 may be under tension, but the only requirement is that band 121 produce a compressive force on fins 106A-B and tubular 100.

Figure 1E:
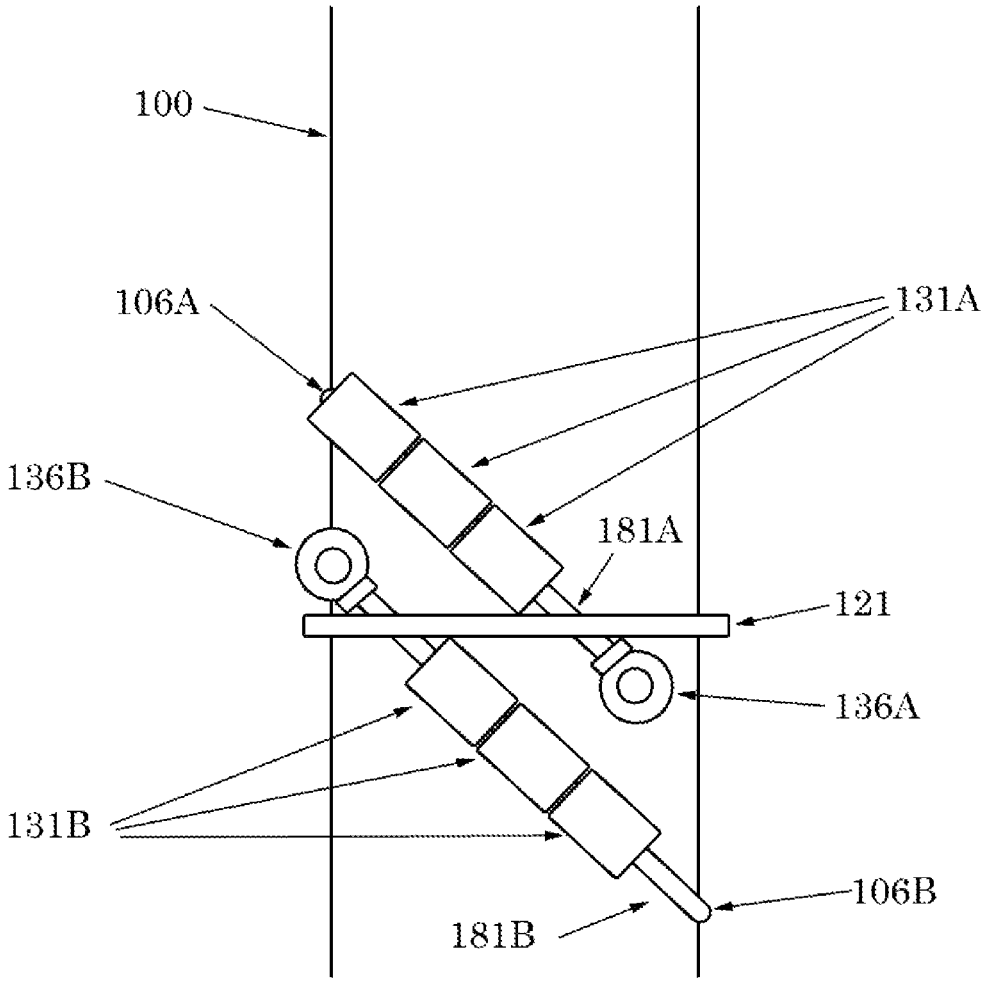
FIG. 1E is a side view of one embodiment of a band holding two-piece fins in place.

Referring to FIG. 1E, FIG. 1E is similar to FIG. 1D except that two part fins are presented along with additional end termination hardware. Representatively, in this embodiment, fins 106A-106B include core portions 181A and 181B and sleeves 131A and 131B. Sleeves 131A-131B are wrapped around core portions 181A-181B, respectively. Core portions 181A-181B are elongated structures which extend around tubular 100 while sleeves 131A-131B are short tubular segments which wrap around core portions 181A-181B, respectively. End terminations 136A and 136B may be used to assist with keeping core portions 181A and 181B in place as well with keeping sleeves 131A-131B from sliding past band 121.

Again referring to FIG. 1E, by placing sleeves 131A-131B around core portions 181A-181B, a relatively large fin which extends out from tubular 100 may be produced. Sleeves 131A-131B may be hollow, and typically there will be a significant annulus between sleeves 131A-131B and core portions 181A-181B. Sleeves 131A-131B and core portions 181A-181B may be of any suitable cross sectional shape, including round, polygonal, elliptical, and partial common shapes (such as a semi-circle). End terminations 136A-136B may consist of any useful device that can be clamped onto, or attached to, core portions 181A-181B such as thimbles, clamps (including hose clamps), hooks, and fasteners. End terminations may also be partially or fully comprised of part of core portions 181A-181B such as by tying a knot along the length.

Still referring to FIG. 1E, sleeves 131A-131B and core portions 181A-181B may be of any suitable size. Typically core portions 181A-181B will range from about 1 percent to 10 percent of the diameter of tubular 100 while sleeves 131A-131B will range from 5 percent to 30 percent of the diameter of tubular 100.

Still referring to FIG. 1E, end terminations 136A-136B, sleeves 131A-131B and core portions 181A-181B may be made of any suitable material including, but not limited to metal, plastic, synthetic, composite, rubber or other elastomer, or combinations of these materials.

Figure 1F:
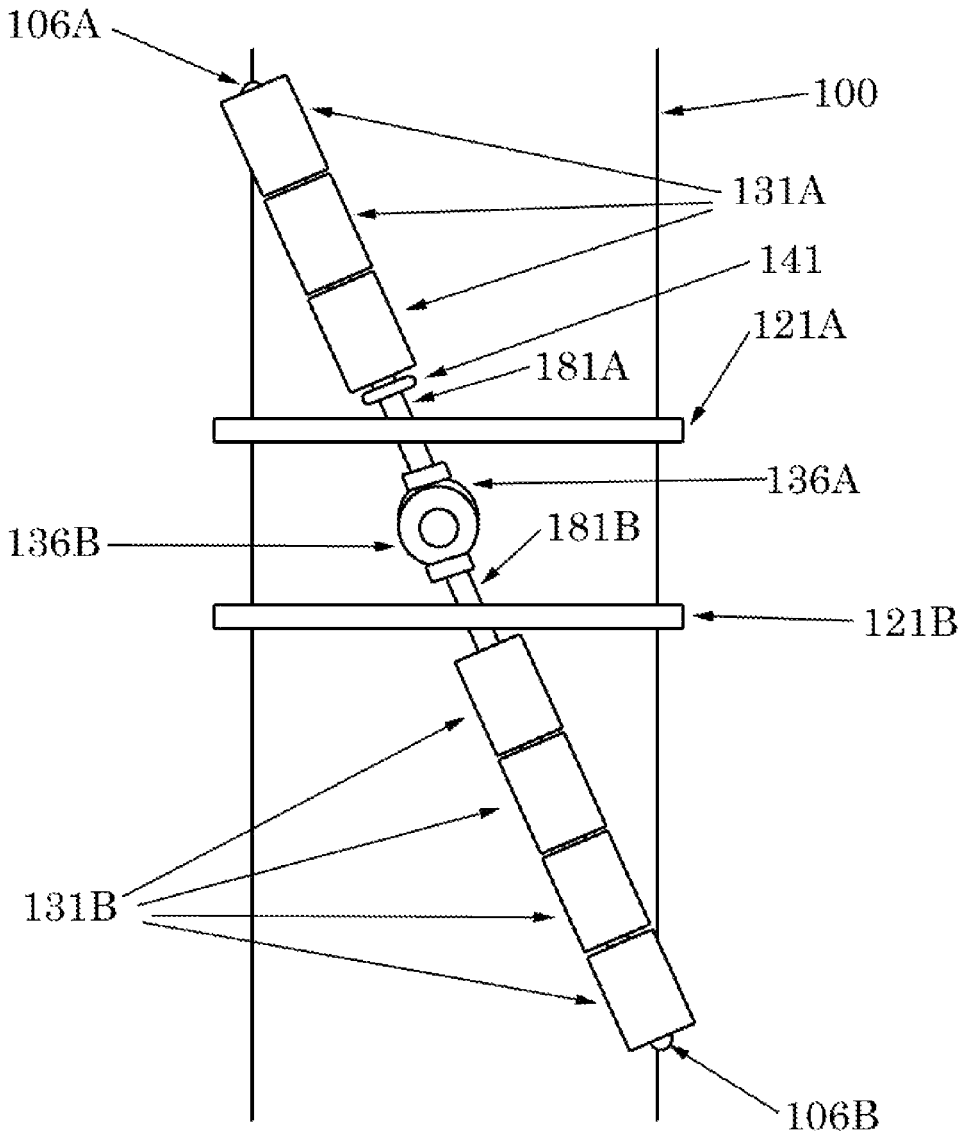
FIG. 1F is a side view of one embodiment of a band holding two-piece fins in place.

Referring to FIG. 1F, this figure is similar to FIG. 1E except that fins 106A and 106B are aligned with one another by aligning their end terminations 136A-136B using bands 121A-121B. In one embodiment, end terminations 136A and 136B may be lined up by placing them under appropriate positions of their adjacent bands 121A-121B and/or by connecting end terminations 136A-136B to each other or to bands 121A-121B. FIG. 1F further illustrates that in some embodiments, a stopper member 141 may be positioned around core portion 181A (or 181B) to help hold sleeves 131A (or sleeves 131B) at a desired position along core portion 181A. Stopper member 141 may be, for example, a clamp, clip, ring, or any other structure capable of preventing movement of sleeves 131A along core portion 181A.

Figure 2A:
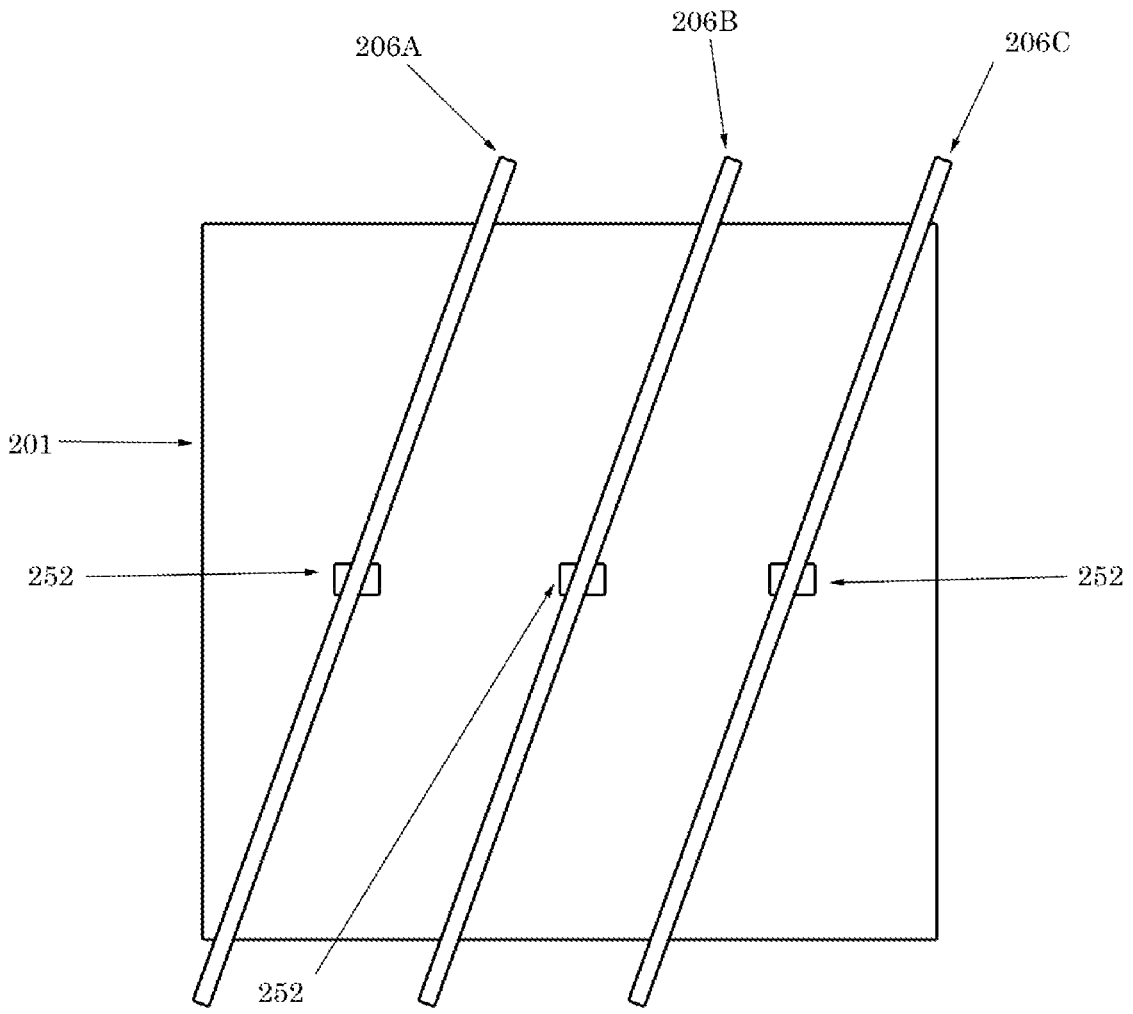
FIG. 2A shows a plan view of one embodiment of a flexible installation sheet for positioning fins around a tubular.

Referring now to FIG. 2A, FIG. 2A shows a wrap 201 with adjacent fins 206A-206C. Openings 252 are present in wrap 201. In this embodiment, fins 206A-206C may be temporarily, or permanently, attached to wrap 201 so that, when wrap 201 is placed around a tubular, fins 206A-206C are helically wrapped around the tubular. Openings 252 are present to assist with attaching fins 206A-206C to the tubular. Wrap 201 may consist of more than one layer to provide proper stiffness and shape for a given application.

Still referring to FIG. 2A, fins 206A-206C may be of any size, similar to the fins discussed above. Wrap 201 may be of any suitable shape (e.g., square, rectangular, circular, triangular, elliptical, etc.) and often will have an odd or non-geometric shape so that it can accommodate the fins and encircle the tubular with minimal overlap. Openings 252 may be of any size and shape so as to fulfill their function of assisting with fin attachment.

Still referring to FIG. 2A, fins 206A-206C and wrap 201 may be of any suitable material including, but not limited to metal, plastic, fabric, synthetic, composite, rubber or other elastomer, or combinations of these materials. For example, fins 206A-206C might consist of a rope such as polyester or nylon rope.

Figure 2B:
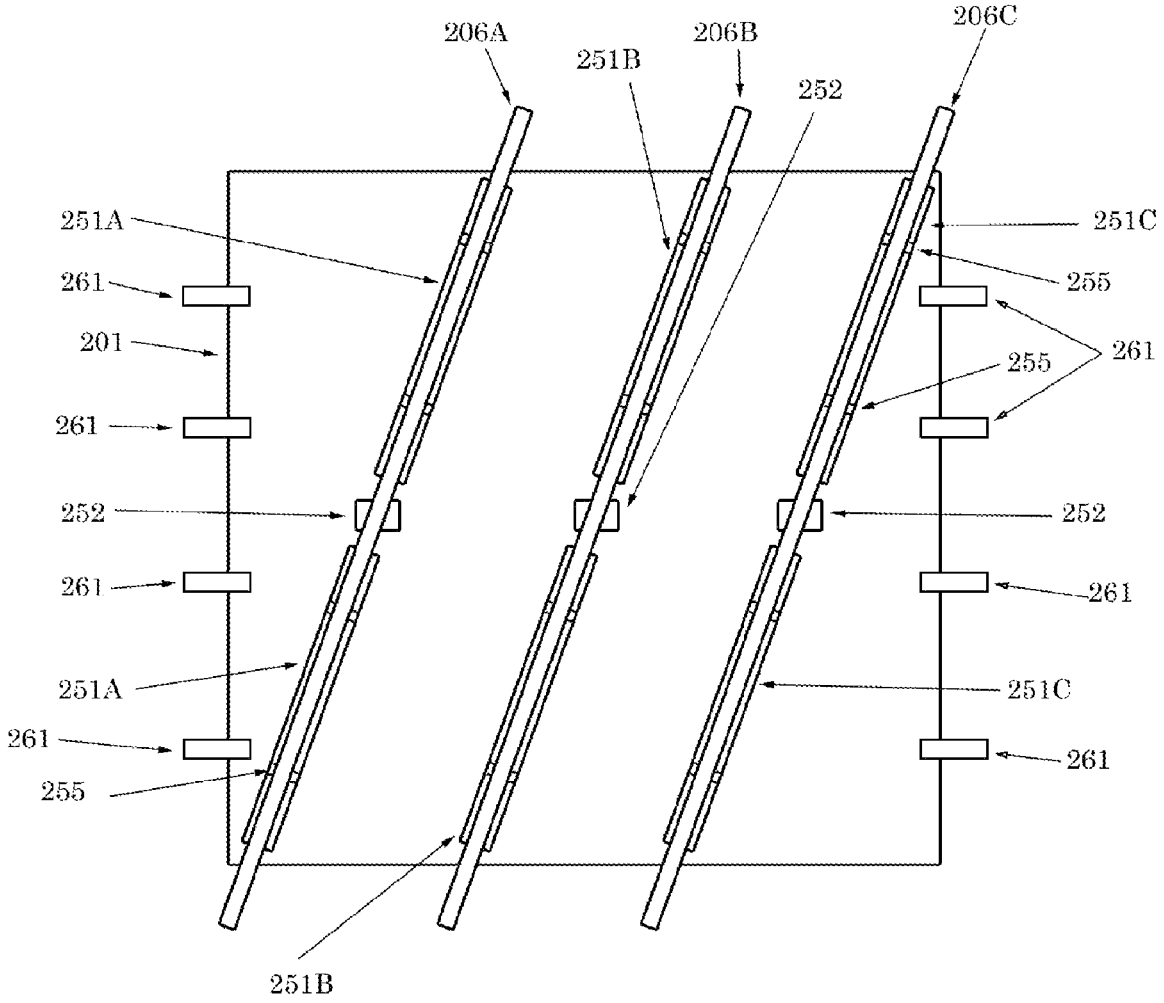
FIG. 2B shows a plan view of one embodiment of a flexible installation sheet for positioning fins around a tubular.

Referring now to FIG. 2B, FIG. 2B is similar to FIG. 2A except that fin openings 251A-251C have been formed in wrap 201. Fasteners 255 attach fins 206A-206C to wrap 201 and openings 252, such as those discussed in reference to FIG. 2A, are present to assist with attaching fins 206A-206C to the tubular.

Again referring to FIG. 2B, fin openings 251A-251C may be of any size or shape but are typically at least a little wider than fins 206A-206C. Fin openings 251A-251C may extend entirely through wrap 201 or may be receptacles or channels formed in wrap 201 which do not extend entirely through wrap 201. Fin openings 251A-251C may be of any suitable orientation but will typically be at an angle relative to the sides of wrap 201. Fins 206A-206C will typically align with fin openings 251A-251C but may be at an angle relative to fin openings 251A-251C. Fins 206A-206C may, or may not, extend past wrap 201 as shown in FIG. 2B. The advantage of extending fins 206A-206C past wrap 201 is that the ends of fins 206A-206C may be banded or clamped against the tubular without removing all of, or part of, wrap 201. However wrap 201 may completely cover fins 206A-206C and additional openings 252 may be used to assist in attaching fins 206A-206C to the tubular.

Fasteners 255 may further be provided to assist with attaching fins 206A-206B to wrap 201. Fasteners 255 may be a tape (shown in FIG. 2B), screws, bolts, clamps, or any suitable fastening material. Fasteners 255 may be permanently attached to wrap 201 and/or fins 206A-C, or fasteners 255 may be temporarily attached to wrap 201 and/or fins 206A-C.

Still referring to FIG. 2B, each of the wrap 201, fins 206A-206C and fasteners 255 may be made of any suitable material. It is further contemplated that in some embodiments, a collar may be substituted for any of the previously discussed bands to facilitate with attachment and/or alignment of fins 106A-106C and/or fins 206A-206C along the associated tubular.

Figure 2C:
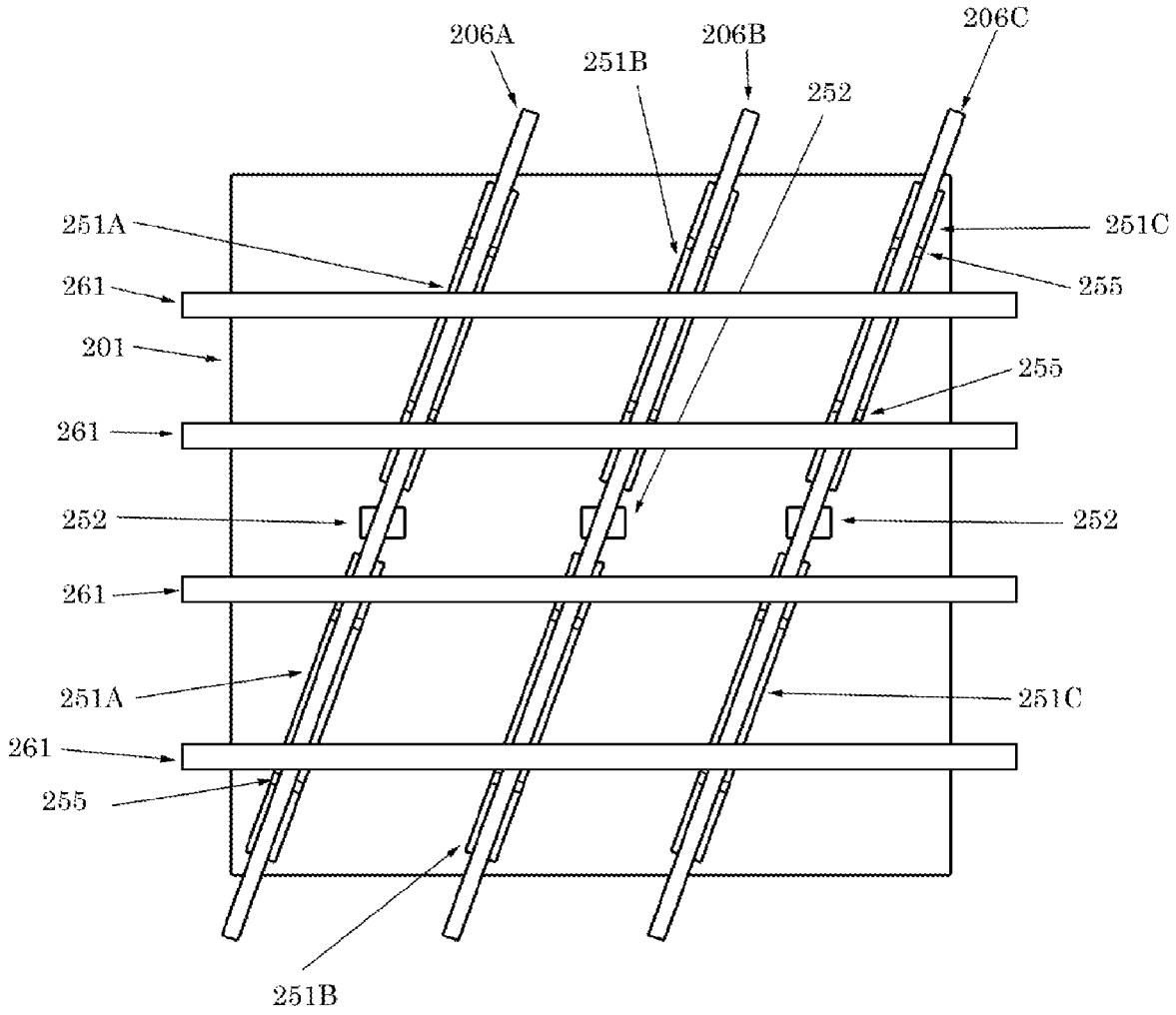
FIG. 2C shows a front plan view of one embodiment of a flexible installation sheet for positioning fins around a tubular.
Figure 2D:
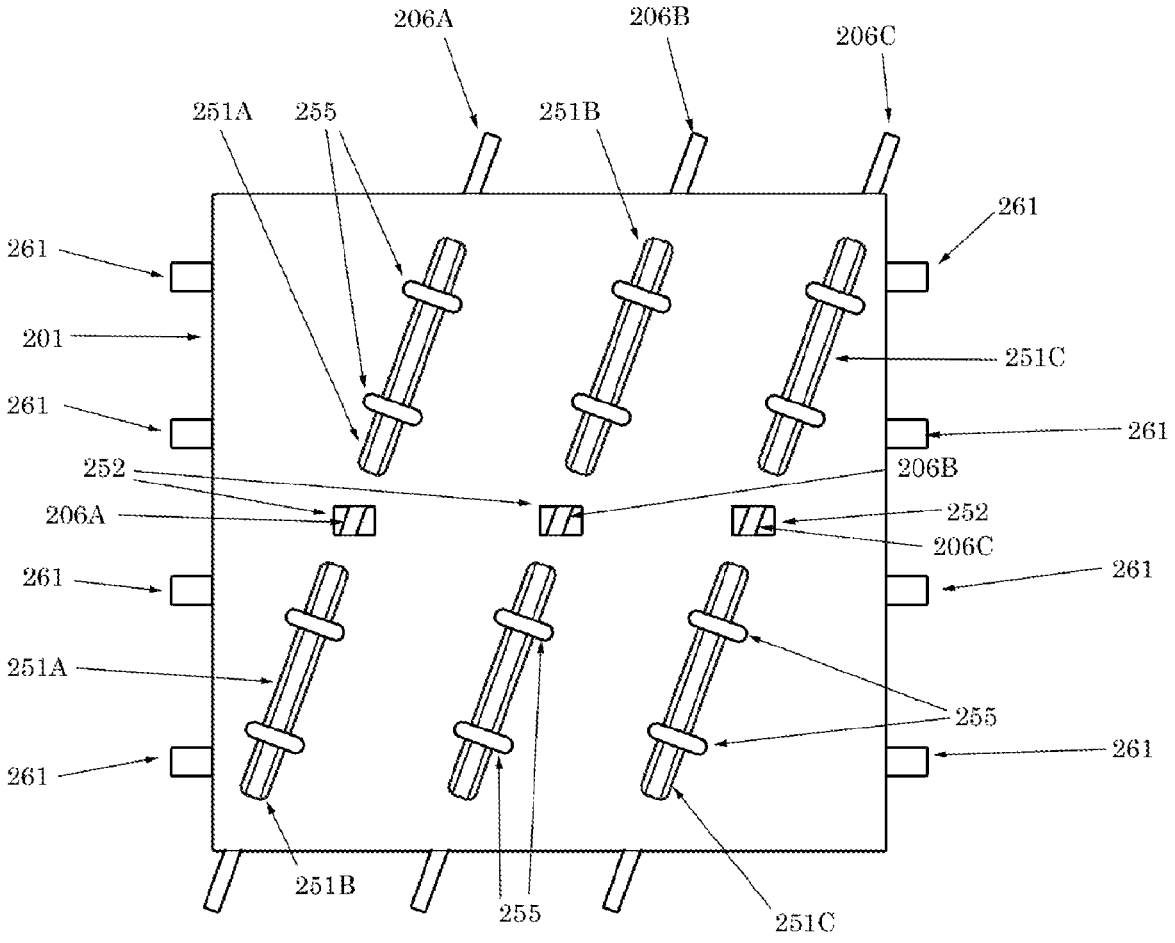
FIG. 2D shows a back plan view of the flexible installation sheet of FIG. 2C.

Referring now to FIG. 2C and FIG. 2D, FIG. 2C and FIG. 2D are similar to FIG. 2B except that straps 261 are included to facilitate positioning of wrap 201 about the tubular. FIG. 2C illustrates a front side view similar to FIG. 2B. Fin openings 251A-251C are shown formed through wrap 201 and aligned with fins 206A-206C. Openings 252 assist with attaching fins 206A-206C to the underlying tubular (not shown). Fasteners 255 (shown as tape segments in FIG. 2C) attach fins 206A-206C to wrap 201.

Again referring to FIG. 2C and FIG. 2D, when wrap 201 is closed around a tubular, fins 206A-206C will be wrapped helically around the tubular. Straps 261 assist in pulling the wrap tight against itself. Straps 261 may be used to temporarily hold wrap 201 closed or may be used to pull on wrap 201 while fins 206A-206C are secured around the tubular. Straps 261 may consist of any suitable mechanism or material. For example, straps 261 may consist of Velcro strips, hooks, buckles, belts, or latches. Once wrap 201 is closed around a tubular, fins 206A-206C are clamped to the tubular using bands, collars, or any suitable attachment device. Openings 252 may be used to assist with clamping fins 206A-206C to the tubular, for example by inserting a band over fins 206A-204C but under the wrap and around the tubular. Once fins 206A-206C are secure, then wrap 201 may be removed by opening straps 261 and removing wrap 201. Fasteners 255 may be removed from wrap 201 or reused to for the next set of fins. Openings 251A-251C may be used for attachment of fins 206A-206C to wrap 201 or openings 251A-251C may be used for simply marking the underlying tubular so that fins 206A-206C may be attached with, or without, wrap 201. Once fins 206A-206C are placed around the tubular, a coating (such as a field joint coating) or other bonding material may be used to keep fins 206A-206C in place on the tubular.

Still referring to FIG. 2C and FIG. 2D, straps 261 may be of any size, shape, or material suitable for attaching wrap 201 to a tubular and may be optional.

Figure 2E:
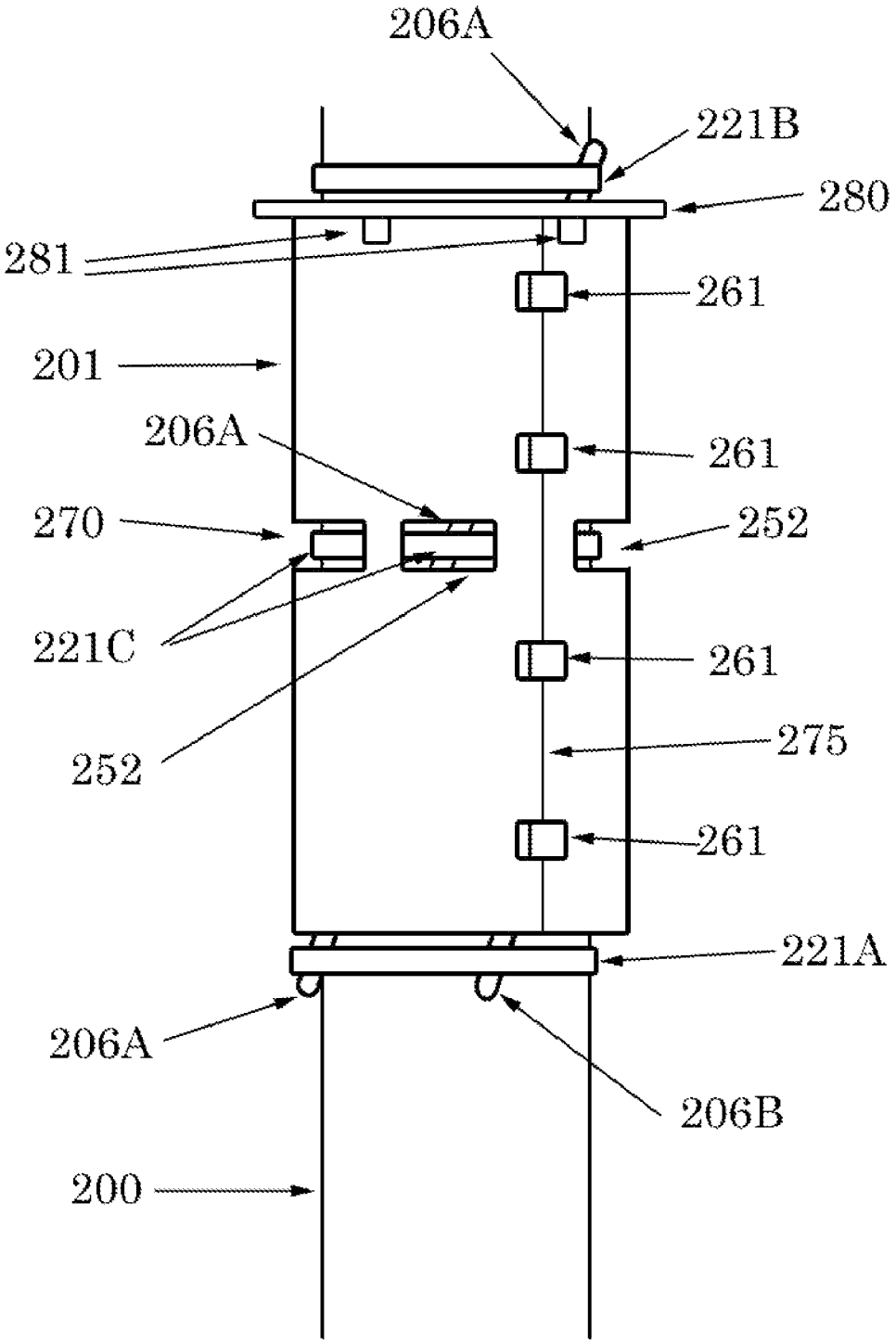
FIG. 2E is a side view of one embodiment of an installation sheet in place around a tubular.

Referring now to FIG. 2E, FIG. 2E shows a wrap 201 similar to the wrap in FIG. 2C placed around tubular 200 with a pull ring 280 and twist handles 281 present. Pull ring 280 and twist handles 281 are attached to, or part of, wrap 201. Fins 206A-206B (fin 206C is not shown) are clamped against tubular 200 by bands 221A-221C while wrap 201 is temporarily secured around tubular 200 using straps 261 along seam 275. Openings 252 are used to assist in getting band 221C into position. Opening 270 is an extra opening shown here that provides room for connecting the two ends of band 221C. Note that any fin openings are not shown in FIG. 2D but, as noted above in the discussion of FIG. 2B, underlying fin receptacles may be present in wrap 201.

Again referring to FIG. 2E, in this embodiment, wrap 201 is placed around tubular 200 and secured with straps 261. Band 221A is then placed around fins 206A-206B to hold them in place (the band 221A may be attached to wrap 201 before installation of wrap 201 or after installation of wrap 201; a collar or other clamping device may be substituted for band 206A). While pulling up on ring 280 and using twist handles 281 to keep the fins 206A-206B in the proper helical position, bands 221C and 221B are secured around fins 206A-206B. Once fins 206A-206B are secured to tubular 200 by bands 221A-221C, wrap 201 may be removed, fitted with three more fins, and the installation process may be repeated.

Still referring to FIG. 2E, opening 270 may be of any suitable size and shape and will typically be sufficiently large to accommodate any installation tools for band 221C. As noted previously, bands 221A-221C may be replaced by collars or other clamping devices in which case opening 270 would be sized to install those devices and accommodate their installation tools. Pull ring 280 and twist handles 281 may be made in any suitable size, shape, or material and may be fastened to wrap 201 or may be integral to wrap 201. Pull ring 280, twist handles 281, and opening 270 are optional but may be used if they are useful for installation of fins 206A-206C around tubular 200.

Figure 3A:
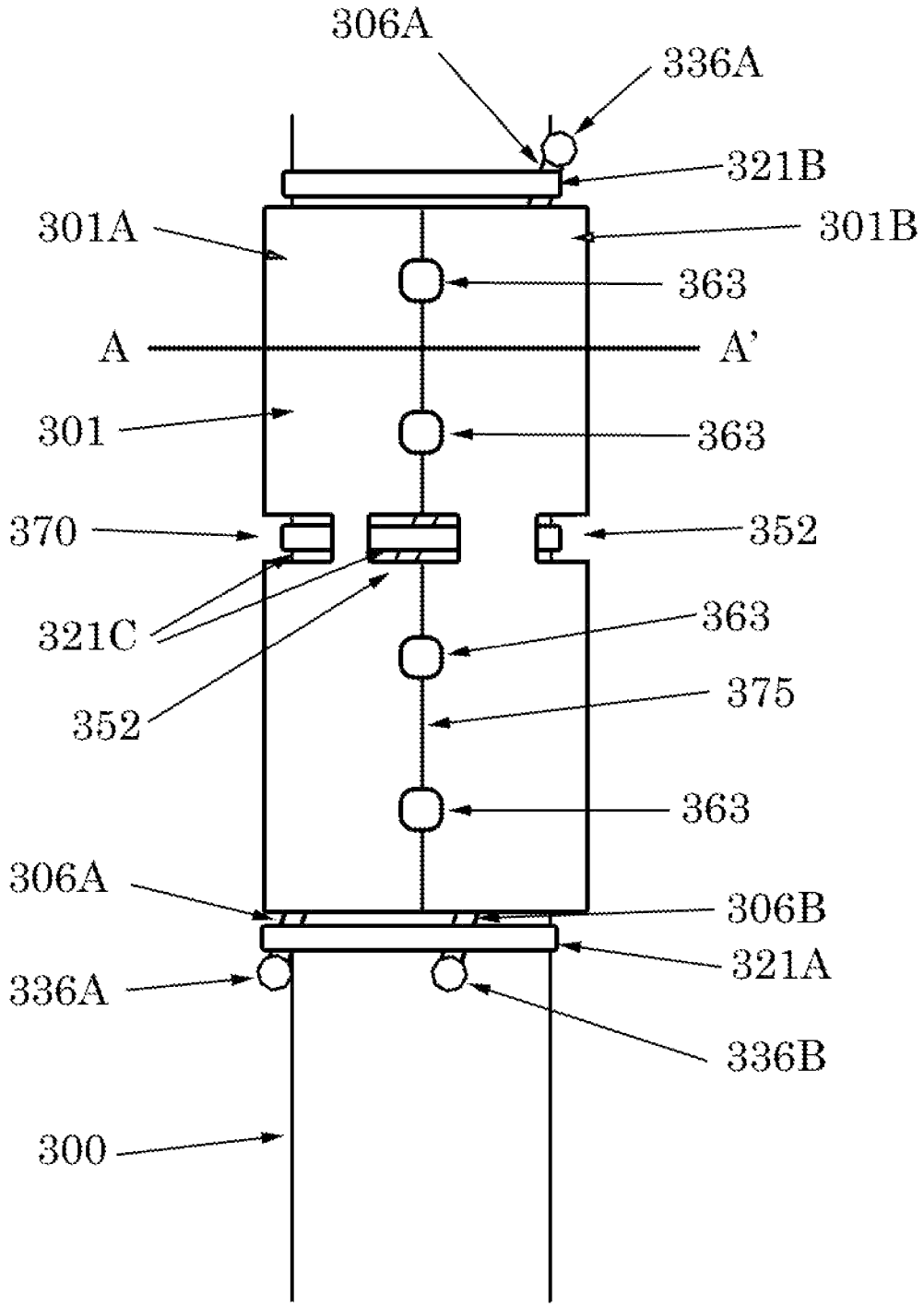
FIG. 3A shows a side view of one embodiment of a rigid installation shell in place around a tubular.

Referring now to FIG. 3A, FIG. 3A illustrates a shell 301 similar to wrap 201 of FIG. 2A-2E except that shell 301 is a more rigid, less flexible shell-type structure having a first section 301A and a second section 301B. Shell 301 may, however, have a similar size and shape to that of wrap 201. Fins 306A-306C may be attached to shell 301 with underlying structures or with openings and fasteners (not shown here but identical to those of FIG. 2B and FIG. 2C). Latches 363 are used to close shell 301 along seam 375 while bands 321A-321C are used to clamp fins 306A-306C to tubular 300. Optional end terminations 336A-336B are used to assist with keeping fins 306A-306C from sliding past the adjacent bands. In this aspect, terminations 336A-336B may be any type of structure capable of modifying (e.g., enlarging) the ends of fins 306A-306C so that they do not slide under bands 321A-321B. Openings 352 and 370 assist with attachment of band 321C.

Again referring to FIG. 3A, when shell 301 is closed around tubular 300 as shown, fins 306A-306C are held against tubular 300. Bands 321A-321C are then tightened around fins 306A-306C and, in the case of band 321C, utilizing openings 352 and 370. Once bands 321A-321C are in place, shell 301 may be removed. Shell 301 may be removed above the ocean surface or it may be removed below the ocean surface. For example, shell 301 may be used to assist with installing fins 306A-306C via s-lay and removed underwater by a diver or by a remote operated vehicle or by other similar methods.

Still referring to FIG. 3A, shell 301 may be any size and may be made of any material suitable for facilitating attachment of fins 306A-306C to tubular 300. Representative materials may include, but are not limited to, plastic, metal, fiberglass, composite, wood, synthetics, and ceramics.

Figure 3B:
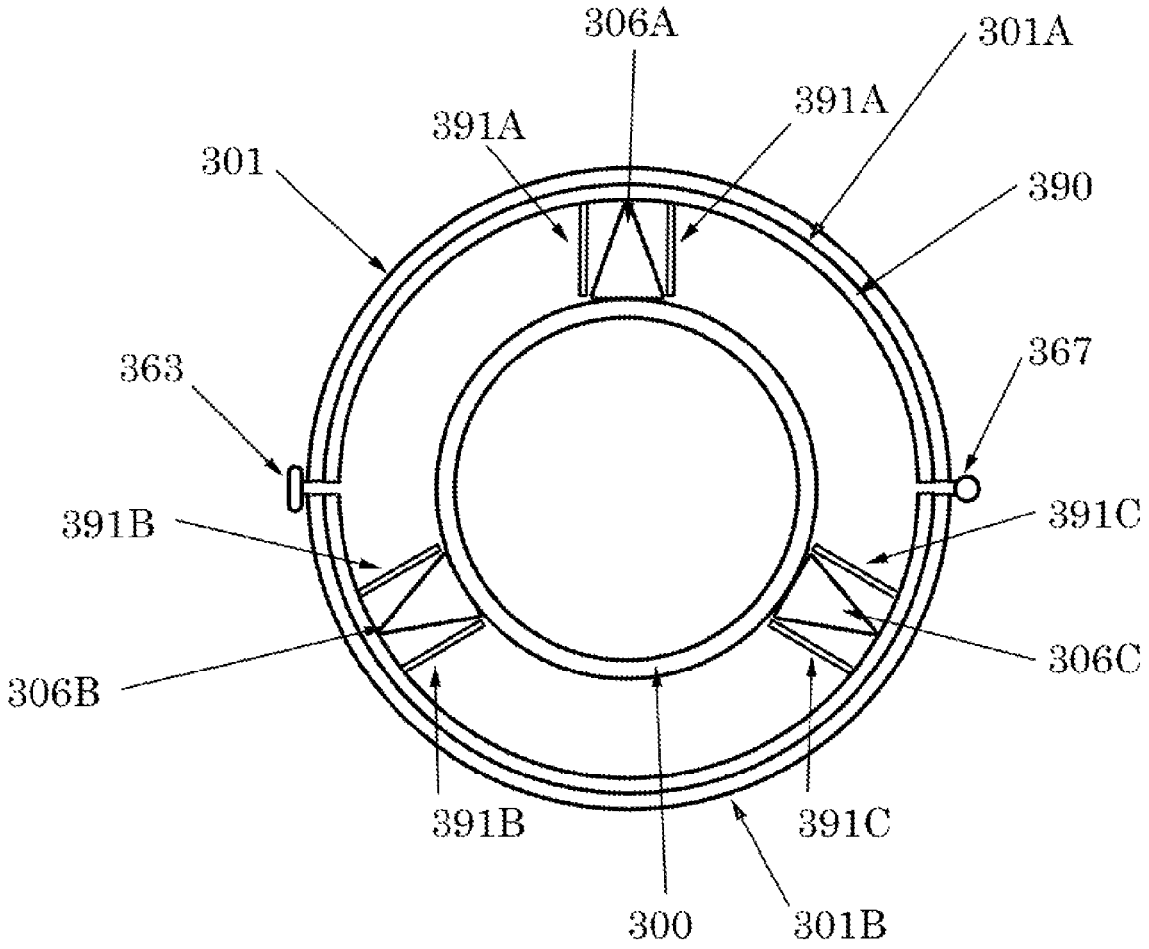
FIG. 3B shows the installation shell of FIG. 3A along line A-A'.

Referring now to FIG. 3B, FIG. 3B is a cross section along line A-A' of FIG. 3A looking downward. Only a representative slice is shown and the bands are omitted. Only a slice of the fins 306A-306C and fin housings 391A-391C are shown for ease of understanding. Shell 301 has optional shell liner 390 attached to it. Fin housings 391A-391C are attached to shell liner 390 and keep fins 306A-306C aligned. In one embodiment, shell 301 and shell liner 390 are formed in sections that can be opened and closed around tubular 300. Hinge 367 and latch 363 may be attached to opposing ends of the shell sections 301A-301B and/or liner sections to allow for shell 301 and shell liner 390 to be opened up and placed around tubular 300.

Again referring to FIG. 3B, shell liner 390 helps to decrease the inside diameter of shell 301 and/or to provide a surface to which to attach fin housings 391A-391C. When shell 301 and shell liner 390 are placed around tubular 300, fins 306A-306C are pressed against tubular 300. The latch 363 may be used to keep the shell 301 and shell liner 390 pressed against the tubular 300. Next, fins 306A-306C may be clamped (e.g., by using the bands shown in FIG. 3A) against tubular 300 after which the shell 301 and shell liner 390 may be removed. Note that, while FIG. 3B shows shell 301 and shell liner 390 to be hinged, it is possible to simply make these parts in two halves and press them against tubular 300 by other means.

Still referring to FIG. 3B, shell liner 390, fin housings 391A-391C, latch 363, and hinge 367 may be made of any shape or material suitable for facilitating attachment of fins 306A-306B to tubular 300, and each are optional with this design.

Figure 4A:
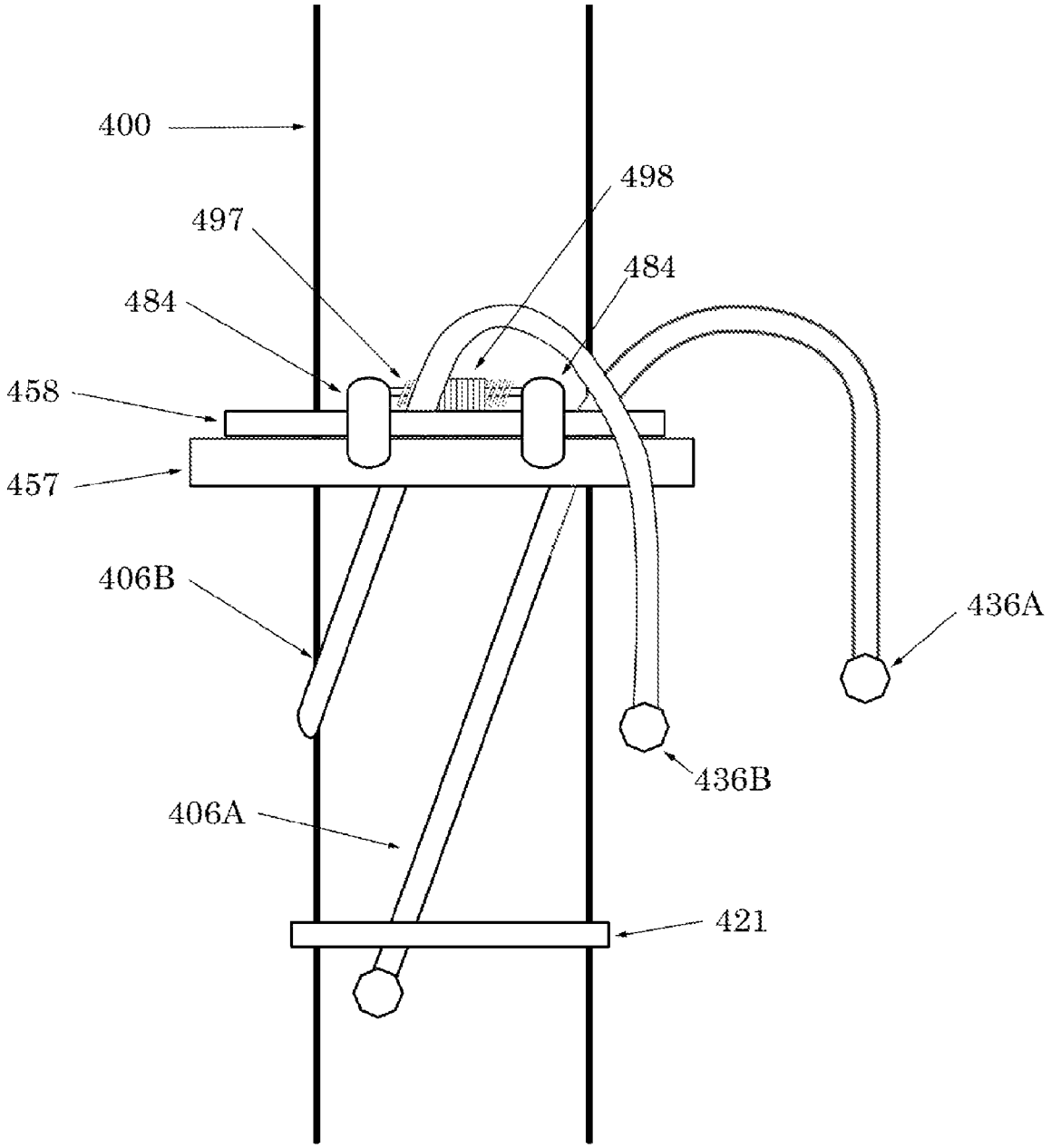
FIG. 4A is a side view of one embodiment of a geared installation ring.

Referring now to FIG. 4A, FIG. 4A is a side view of an installation method that has fins 406A-406B attached against tubular 400 using band 421 and other bands (not shown). Outer ring 457 is concentric with tubular 400 and inner (rotating) ring 458, which is hidden in this view but can be seen in FIG. 4B. Worm gear 497 turns gear 498 which, in turn, rotates ring 458. Handles 484 allow for ease of moving the rings axially along tubular 400. End terminations 436A-436B assist in keeping fins 406A-406B from sliding under the bands.

Again referring now to FIG. 4A, when outer ring 457 is pushed axially (upwards in FIG. 4A) by pushing on optional handles 484, worm gear 497 turns and engages gear 498 which, in turn, rotates inner ring 458. Fins 406A and 406B go through slots in ring 458 that wind fins 406A-406B axially along tubular 400 as outer ring 457 traverses axially along tubular 400. Outer ring 457 is donut shaped so that fins 406A-406B can move freely around tubular 400 without engaging outer ring 457.

Still referring to FIG. 4A, outer ring 457, inner ring 458, handles 484, worm gear 497, and gear 498 may be of any size suitable for positioning fins 406A-406B around tubular 400. Typically, worm gear 497 and gear 498 are sized to produce the required pitch for the helical winding of fins 406A-B. Other gear types may also be used with the only limitation being that the gearing function must translate the axial movement of outer ring 457 to a combined axial and rotational movement of fins 406A-B. Other ring arrangements may also be used to assist with providing structural support for this function.

Still referring to FIG. 4A, outer ring 457, inner ring 458, handles 484, worm gear 497, and gear 498 may be made of any material suitable for facilitating attachment of fins 406A-406B about tubular 400.

Figure 4B:
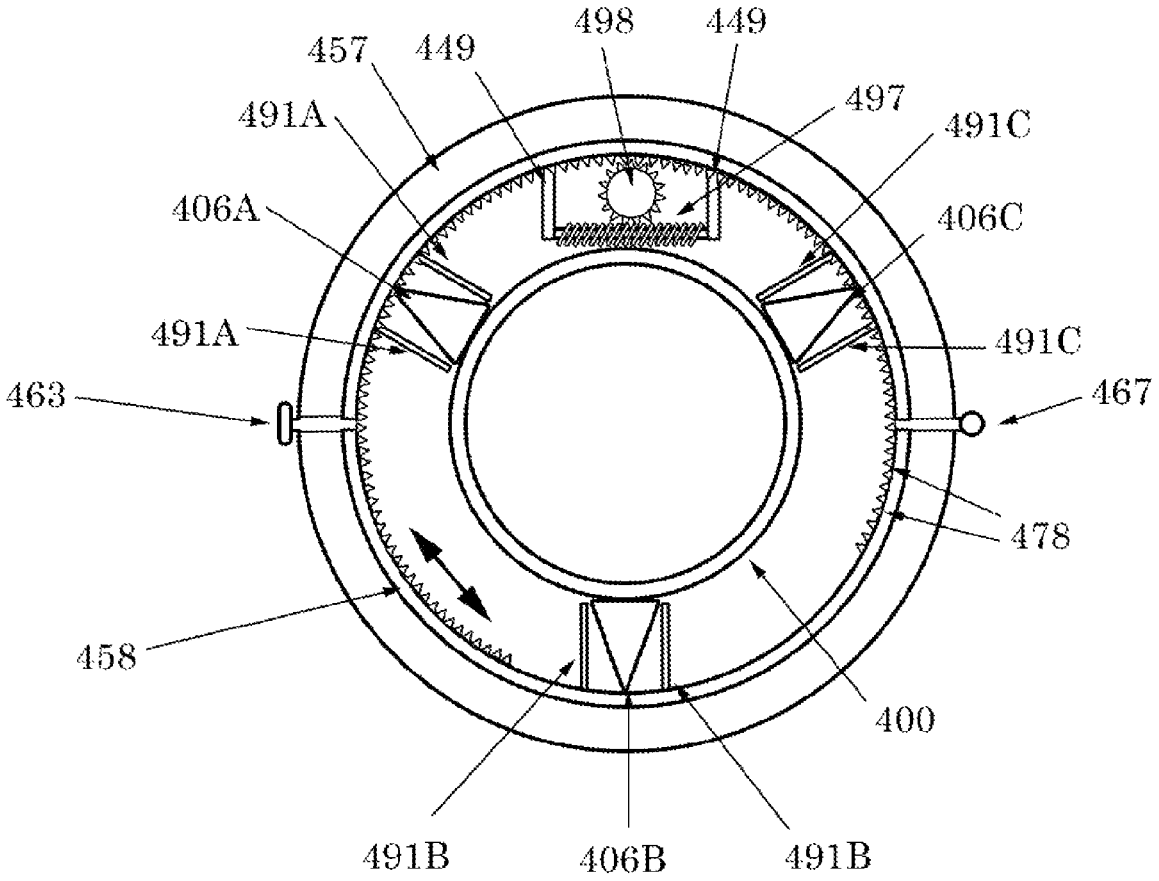
FIG. 4B is an end view of the geared installation ring of FIG. 4A.

Referring to FIG. 4B, FIG. 4B shows an end view of FIG. 4A except that only a cross section of fins 406A-406C and fin housings 491A-491C are shown. The handles are also omitted for clarity. FIG. 4B shows outer ring 457 and inner ring 458 approximately concentric with tubular 400. Outer ring 457 and inner ring 458 have hinge 467 and latch 463 to ease with placement around tubular 400. Fin housings 491A-491C can extend from an inner surface of inner ring 458 and toward tubular 400. In this aspect, fin housings 491A-491C can hold fins 406A-406C in place against tubular 400 while they are being helically wound around tubular 400. Representatively, as inner ring 458 rotates and travels along the tubular axis, fins 406A-406C slide through housings 491A-491C. Worm gear 497 rotates as the rings travel along the tubular axis and, in turn, turns gear 498 which, in turn, turns inner ring 458 through inner ring gear teeth 478. Worm gear 497 is attached to ring 458 through struts 449.

Again referring to FIG. 4B, fin housings 491A-491C may be of any size and shape suitable for keeping fins 406A-406B in place adjacent to tubular 400 and thus any suitable design will work. For example, housings 491A-491C may be channels, recesses or other similar structure that retains fins 406A-406C and open in a direction of tubular 400 so that fins 406A-406C face tubular 400 and can slide through housings 491A-491C as they are being helically wound around tubular 400. Inner ring gear teeth 478 extend along an inner circumference of inner ring 458, however, do not necessarily have to cover the entire circumference of inner ring 458 depending upon how much of the circumference is traversed as outer ring 457 travels down the pipe to install a given set of fins 406A-406C. Worm gear 497, gear 498, inner ring gear teeth 478, and inner ring 458 may be customized for a given application. Tubular diameter, fin size, desired fin pitch, etc. will determine the actual sizes and geometry of each of these parts.

Still referring to FIG. 4B, each part may be made of any material suitable for facilitating installation of fins 406A-406C about tubular 400. For this design, and for all of the other designs presented herein, it is to be understood that any number of fins and fin housings may be used. In some embodiments, fin housings 491A-491C may be omitted and other methods may be used to keep fins 406A-406C in place during installation, such as fastening or gluing fins 406A-406C to ring 458.

Figure 4C:
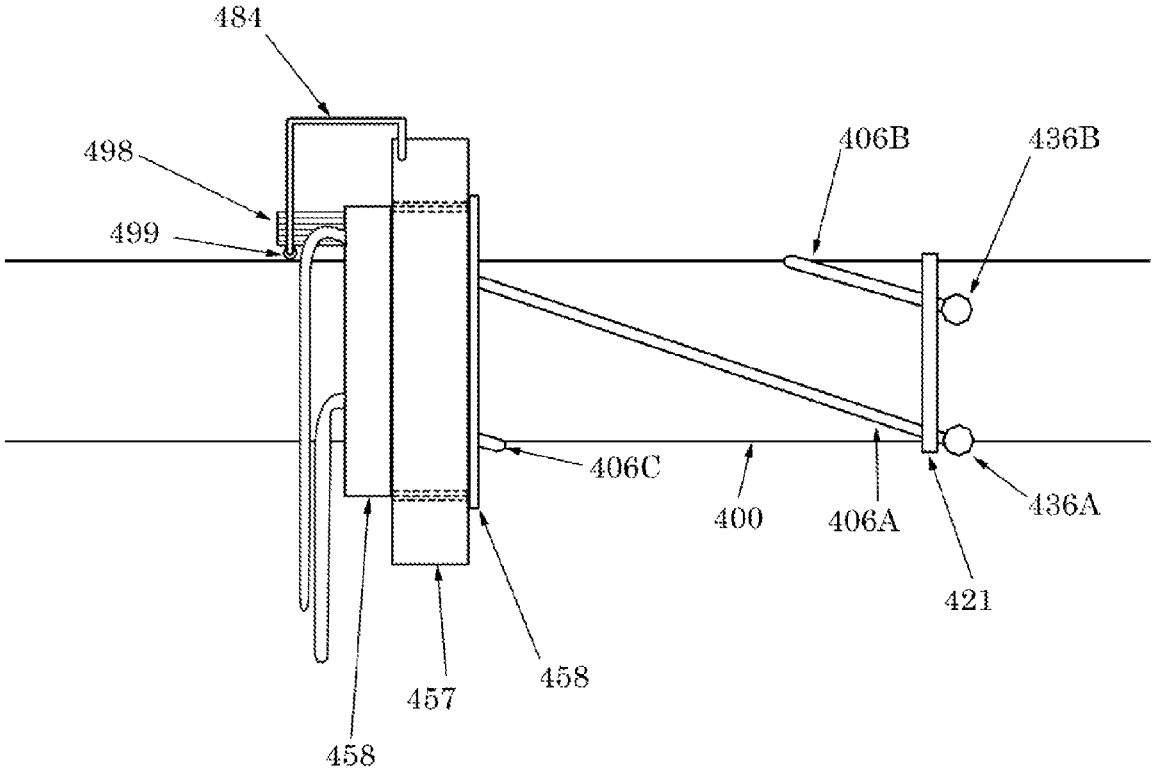
FIG. 4C is a side view of one embodiment of a geared installation ring that is perpendicular to the view of FIG. 4A.

Referring now to FIG. 4C, this figure is similar to FIG. 4A except a different angle is shown and inner ring 458 has a slightly different design. In FIG. 4C, inner ring 458 extends through the opening of outer ring 457 which helps support outer ring 457 to keep it concentric with ring 457. FIG. 4C also illustrates how handles 484 might connect to outer ring 457. Band 421 keeps fins 406A-406B in place at one end, and end connectors 436A-436B help insure fins 406A-406B do not slide out from under band 421. In this aspect, end connectors 436A-436B may be structures which are part of, or attached to, the end of fins 406A-406B and of any size and shape suitable to prevent fins 406A-406B from sliding out from under band 421. Worm gear 499, gear 498, and inner ring 458 assist in turning inner ring 458 as outer ring 458 is pushed along tubular 400.

Again referring to FIG. 4C, when inner ring 458 turns around tubular 400, the portions on both sides of outer ring 457 turn together. Outer ring 457 does not turn. If outer ring 457 moves from right to left in FIG. 4C, worm gear 499 and gear 498 will stay on top of the pipe as shown, but inner ring 458 will rotate thereby wrapping fins 406A-406B helically around tubular 400. Inner ring 458 may be designed to produce a little tension in fins 406A-406B to keep them tight against tubular 400. This tension may be imposed by any one of several means, ranging from a geometric misalignment of the fin as it passes through inner ring 458 to one or more actual springs that keep fins 406A-406C in tension.

Figure 5A:
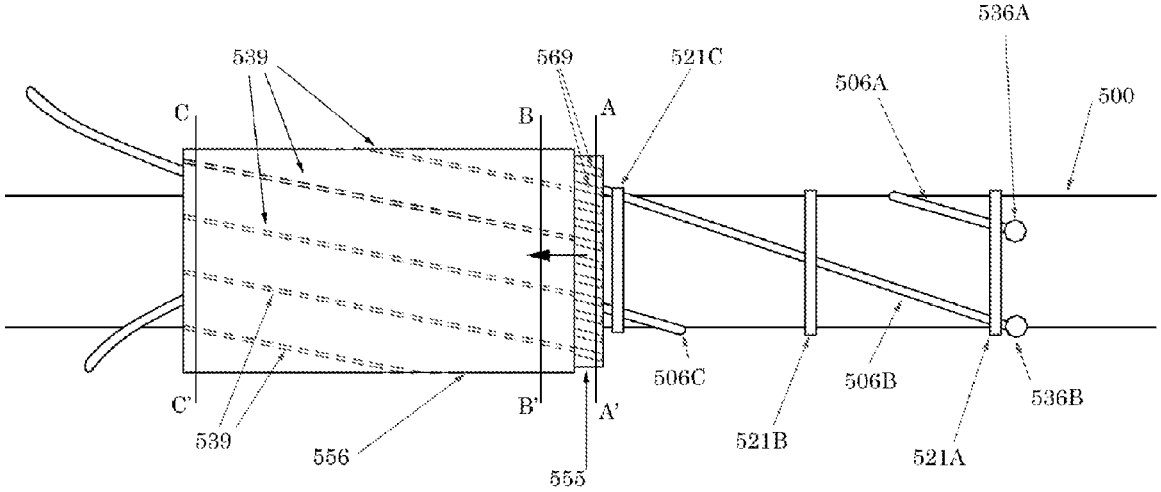
FIG. 5A is a side view of one embodiment of a sleeved installation ring.

Referring now to FIG. 5A, this figure shows a ring 555 that rotates through a sleeve 556. Ring 555 has ring ridges 569 that rotate when they engage internal sleeve ridges 539 in sleeve 556. Fins 506A-506C extend through sleeve 556 and ring 555 and to an end that may have optional end terminations 536A-536B, such as any of those previously discussed. Fins 506A-506C are clamped to tubular 500 by bands 521A-521C.

Again referring to FIG. 5A, as ring 555 travels from right to left through sleeve 556, the internal sleeve ridges 539 and the ring ridges 569 on ring 555 cause it to rotate. As fins 506A-506C pass through ring 555, they are adjacent to tubular 500 and pass through helically due to the ring rotation. The bands 521A-521C are used to keep the fins 506A-506C in place against tubular 500. Use of end terminations 536A-536B may allow for greater tension to be put onto fins 506A-506C which may allow for less dense use of bands 521A-521C. Multiple sleeves 539 may be used to allow for faster installation of fins 506A-506C. Sleeve 539 and ring 555 may be slid over the end of tubular 500 or made in one or more parts that are fastened together through hinges, fasteners, latches, or any suitable means.

Still referring to FIG. 5A, sleeve 556, ring 555, fins 506A-506C, and bands 521A-521C may be made in any size or shape suitable for installation of fins 506A-506C about tubular 500. Fins 521A-521C may be flexible to allow for ease of installation. Internal sleeve ridges 539 and ring ridges 569 may be of any quantity, circumferential coverage, size, shape, and angle that is desired, and will typically be designed to produce the desired pitch (angle relative to the pipe longitudinal axis).

Still referring to FIG. 5A, all parts may be made of any material suitable for installing fins about a tubular, such as any of the previously discussed materials, and more than one material may be used for a given part.

Figure 5B:
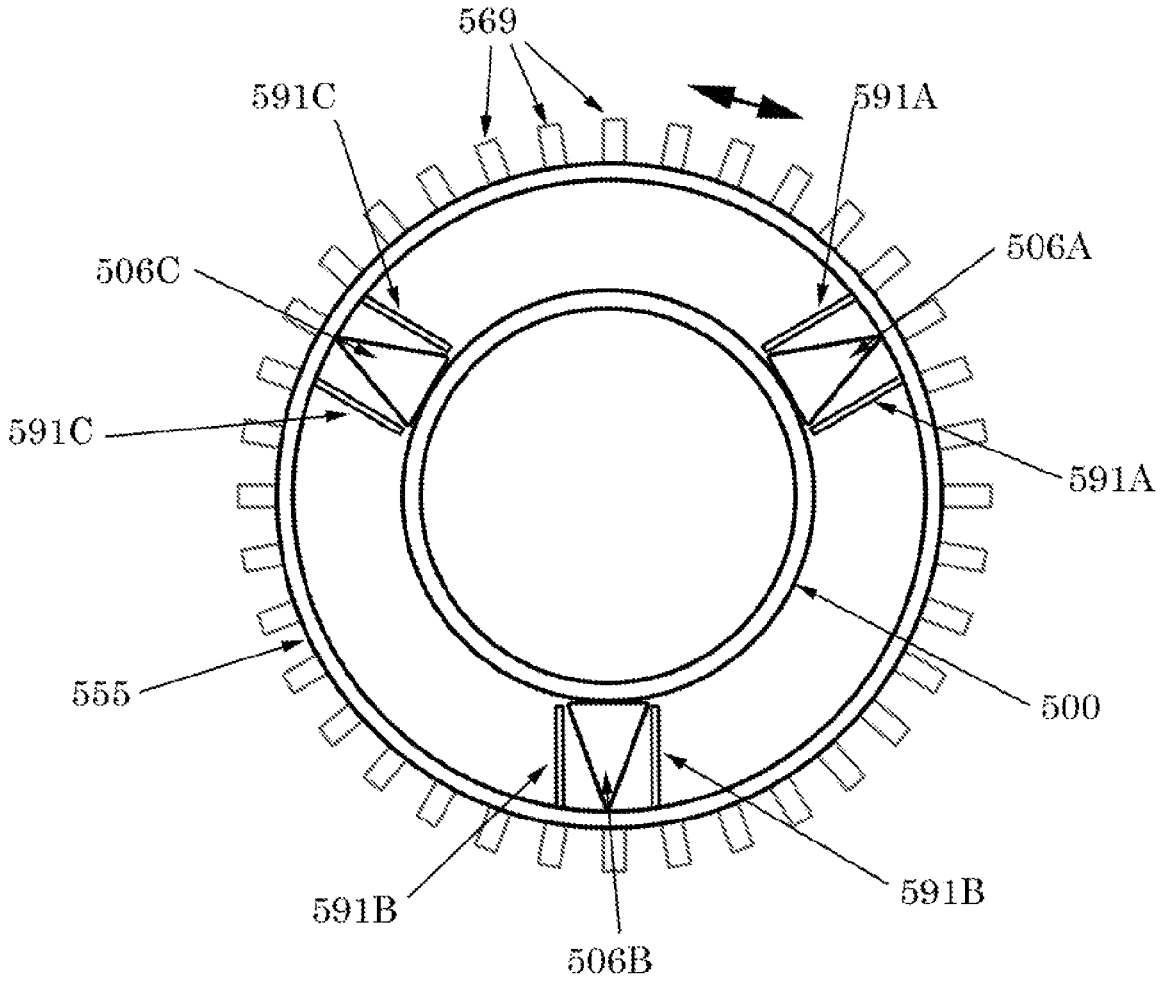
FIG. 5B is a cross section view of the sleeved installation ring of FIG. 5A along line B-B'.

Referring to FIG. 5B, this figure shows cross-section along line BB' of FIG. 5A across the ring 555. Ring 555 is shown centralized onto tubular 500 by fin housings 591A-591C and fins 506A-506C. Ring ridges 569 are shown along the exterior of ring 555.

Again referring to FIG. 5B, fin housings 591A-591C keep the fins from moving along the circumferential direction of tubular 500 and adjacent to tubular 500. The fin housings 591A-591C may be formed by any structure and geometry suitable for keeping the fins from moving along the circumferential direction of tubular 500 and adjacent to tubular 500. For example, fin housings 591A-591C may consist of channel, tape, fasteners, or any other suitable method of housing fins 506A-506C. Fin housings 591A-591C may be of any suitable size and material.

Figure 5C:
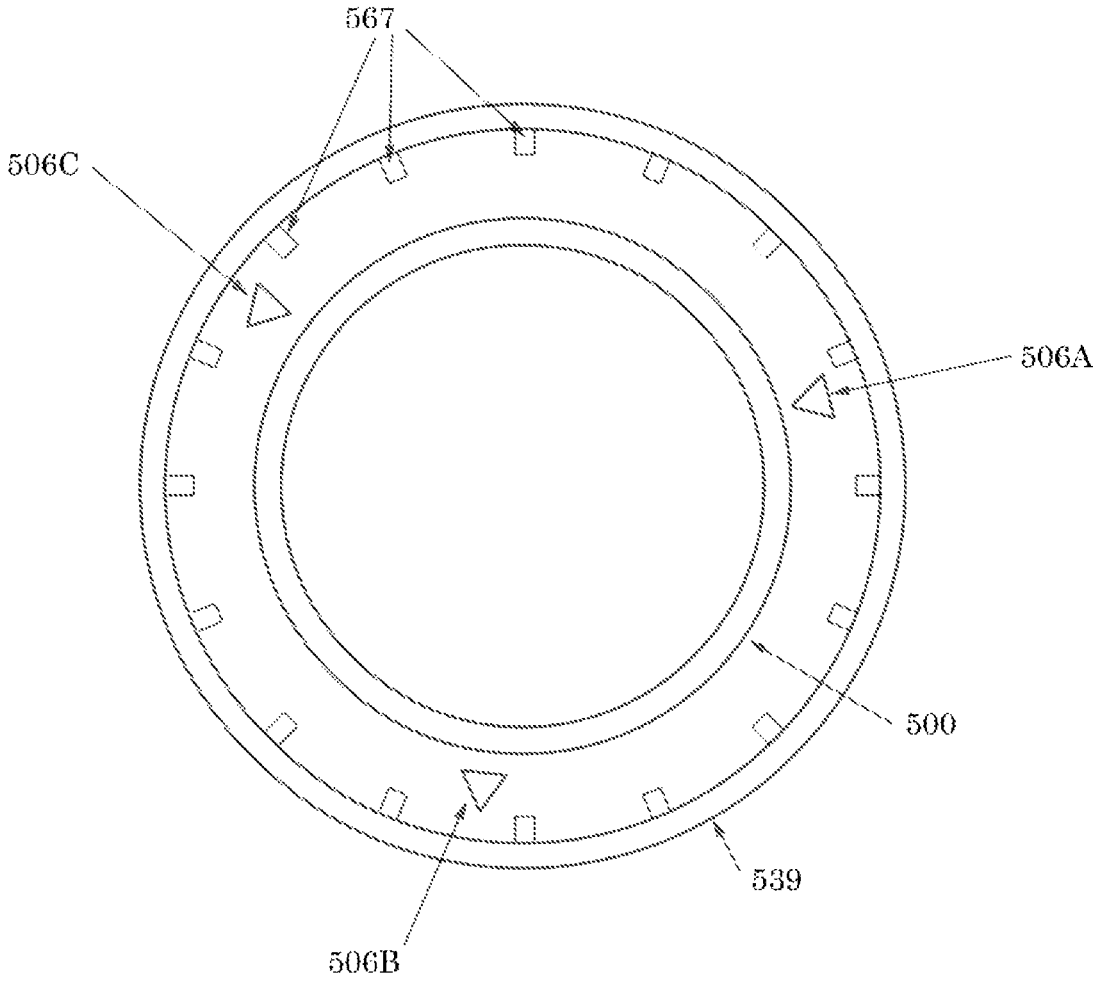
FIG. 5C is a cross section view of the sleeved installation ring of FIG. 5A along line C-C'.

Referring to FIG. 5C, this figure shows cross section C-C' of FIG. 5A across sleeve 539 near the ring end. Internal sleeve ridges 567 are attached or part of sleeve 556 and the sleeve is external to tubular 500. Fins 506A-506C are free to move inside of sleeve 556 and are each shown at only one possible location.

Again referring to FIG. 5C, since sleeve 539 is not free to rotate about tubular 500, fins 506A-506C will move around inside the annulus between sleeve 539 and tubular 500 as fins 506A-506C are installed. Any number of internal sleeve ridges 567 may be used and they may be of any size or shape. Internal sleeve ridges 567 may, or may not, cover the entire circumference of the inside of sleeve 539.

Still referring to FIG. 5C, internal sleeve ridges 567 may be made of any suitable material but will typically be sufficiently rigid and strong such that they stay in place with minimal deformation during installation of fins 506A-506C.

Figure 5D:
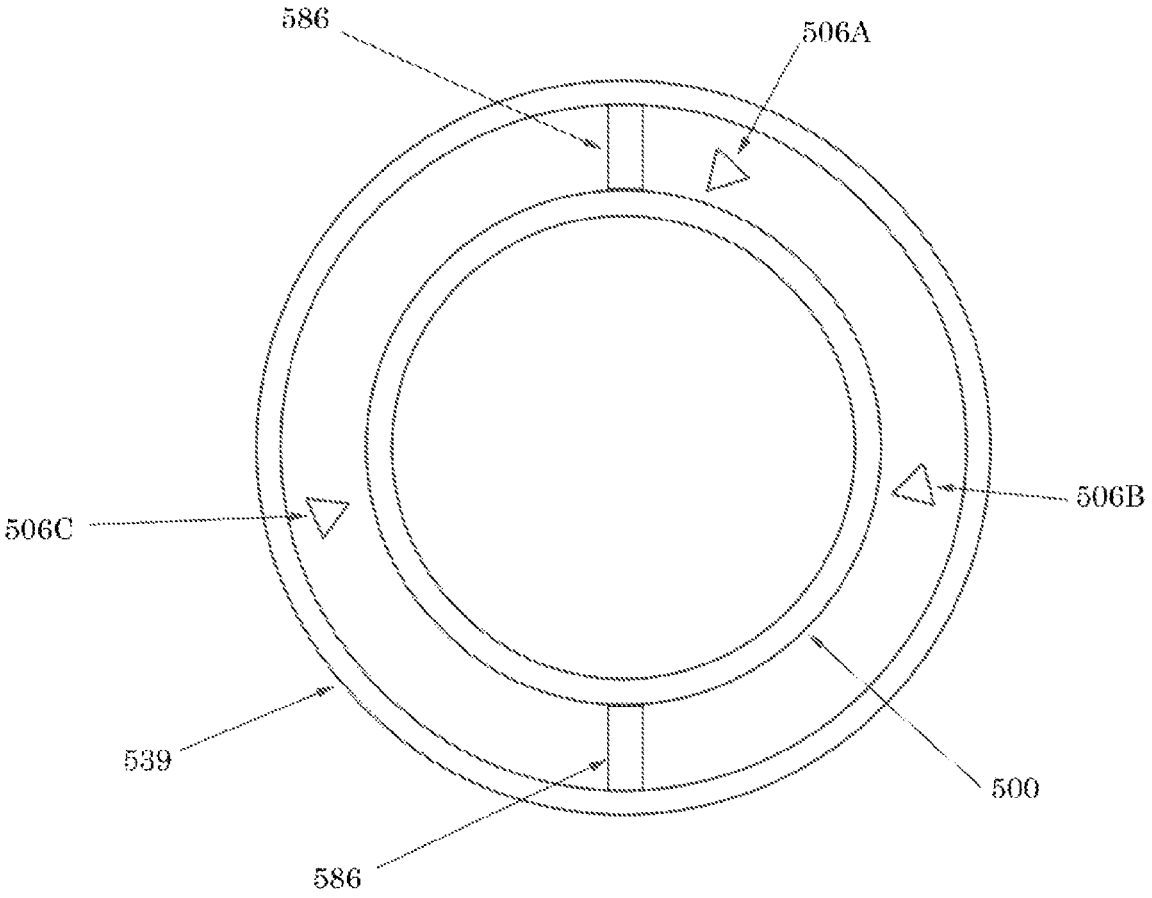
FIG. 5D is a cross section view of the sleeved installation ring of FIG. 5A along line D-D'.

Referring now to FIG. 5D, this figure shows a cross section along line D-D' of FIG. 5A across sleeve 539 near the clamped end. At this end, internal sleeve ridges are not required (but may be present) and thus are not shown. Fins 506A-506C are free to move around inside of the annulus between sleeve 539 and tubular 500. However, sleeve supports 586 will restrict the movement of fins 506A-506C to the area between adjacent sleeve supports. Sleeve supports 586 are used to keep sleeve 539 approximately concentric with tubular 500 with an annulus sufficient for installation of fins 506A-506C.

The above embodiments may be mixed and matched to form an installation system or method. For example, the embodiments of FIG. 2A-D may be used in conjunction with the reeled installation system presented in FIG. 1A-F. The various features of each embodiment may be used in the other embodiments even if they are not specifically listed in the discussion of that invention.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. For several of the ideas presented herein, one or more of the parts may be optional. The invention should therefore not be limited by the above described embodiment, method, and examples, but by all embodiments and methods within the scope and spirit of the invention.

What is claimed is:

1. An apparatus for helically installing a vortex-induced vibration (VIV) suppression fin about a tubular, the apparatus comprising:

a support member configured to wrap a VIV suppression fin helically around a tubular, the support member comprising an attachment opening and an alignment opening, the attachment opening and the alignment opening being formed entirely through the support member, the attachment opening being formed between a first portion and a second portion of the alignment opening, and each of the first portion and the second portion of the alignment opening are an elongated opening having a different size than the attachment opening and extend from the attachment opening at an angle to a longitudinal axis of the support member, and wherein the support member is modifiable between a first open configuration and a second closed configuration, wherein in the closed configuration, the VIV suppression fin is in a helical shape suitable for installation around the tubular in the absence of a cylindrical shell positioned between the VIV suppression fin and the tubular.

2. The apparatus of claim 1 further comprising:

a fastener to facilitate attachment of the VIV suppression fin helically around the tubular once the support member is removed.

3. The apparatus of claim 1 wherein the support member is a bendable support member that is substantially flat in the first open configuration such that the VIV suppression fin is straight in the first open configuration.

4. The apparatus of claim 1 wherein the alignment opening is dimensioned to receive and retain the VIV suppression fin in an orientation such that when the support member is positioned around the tubular, the VIV suppression fin is helically positioned along the tubular.

5. The apparatus of claim 1 further comprising:

a strap extending from the support member to temporarily strap the support member around the tubular.

6. The apparatus of claim 1 wherein the fin is removably retained along the support member such that the support member is operable to be removed from the VIV suppression fin once the VIV suppression fin is positioned around the tubular.

7. The apparatus of claim 1 further comprising:

a twisting member attached to one end of the support member, wherein the twisting member is dimensioned to facilitate twisting of the VIV suppression fin into a helical shape around the tubular when the support member is positioned around the tubular in the second closed configuration.

8. The apparatus of claim 1 further comprising:

a band member dimensioned to helically secure the VIV suppression fin to the tubular.

* * * * *